US007000669B2

(12) United States Patent
Hsu

(10) Patent No.: US 7,000,669 B2
(45) Date of Patent: Feb. 21, 2006

(54) LOCATING DEVICE OF FAN-LIKE BLIND EMBODIMENT

(75) Inventor: Ben Hsu, Changhua Hsien (TW)

(73) Assignee: Ching Feng Blinds Inc. Co., Ltd., Changhua Hsien (TW)

( * ) Notice: Subject to any disclaimer, the term of this patent is extended or adjusted under 35 U.S.C. 154(b) by 35 days.

(21) Appl. No.: 10/736,521

(22) Filed: Dec. 17, 2003

(65) Prior Publication Data

US 2005/0133168 A1 Jun. 23, 2005

(51) Int. Cl.
*E06B 9/48* (2006.01)

(52) U.S. Cl. ..... 160/84.07; 160/134

(58) Field of Classification Search ..... 160/84.07, 160/134; 428/4

See application file for complete search history.

(56) References Cited

U.S. PATENT DOCUMENTS 5,117,889 A * 6/1992 Coe ..... 160/134

2004/0112548 A1 * 6/2004 Militello et al. ..... 160/84.07

* cited by examiner

*Primary Examiner*—Blair M. Johnson
(74) *Attorney, Agent, or Firm*—Troxell Law Office, PLLC

(57) ABSTRACT

A locating device of a fan-like blind embodiment includes a door/window with a frame, a fan-like patterned blind embodiment attached at the top of the frame thereon, and a locating device adapted into a room exposed under the base of the patterned blind embodiment thereof wherein the locating device is made up of a retaining mount and a pair of supporting boards. The retaining mount thereof has an arc top surface to sustain the base of the blind embodiment in abutting location, a through hole to securely fix the retaining mount onto the top of the door/window frame thereby, and a coupling groove for protruded parts of the support boards to be inserted thereto for location thereby. Via the locating device, the patterned blind embodiment is securely supported by the arc top surface of the retaining mount at the base thereof and limited by the support boards at both front and rear sides thereof so that, in the repeated closing/opening of the door/window, the patterned blind embodiment can be stably located at the frame of the door/window thereon without tilting or falling there-from, effecting the best using condition thereof.

2 Claims, 4 Drawing Sheets

LOCATING DEVICE OF FAN-LIKE BLIND EMBODIMENT

BACKGROUND OF THE INVENTION

The present invention is related to a locating device of a fan-like blind embodiment, comprising a door/window with a frame, a fan-like patterned blind embodiment attached at the top of the frame thereon, and a locating device adapted into a room exposed under the base of the patterned blind embodiment thereof wherein the locating device is made up of a retaining mount and a pair of supporting boards. The retaining mount thereof has an arc top surface to sustain the base of the patterned blind embodiment in abutting location thereon, a through hole to securely fix the retaining mount onto the top of the door/window frame thereby, and a coupling groove for protruded parts of the support boards to be inserted thereto for location thereof; whereby, in the repeated closing/opening of the door/window, the patterned blind embodiment is stably located at the door/window frame thereon without tilting or falling there-from, effecting the best using condition thereof.

Please refer to FIG. 1. A conventional locating device of a fan-like blind embodiment is made up of a door/window 10 with a frame 11, a piece of transparent glass 12 securely fixed at the front top side of the frame 11 thereon, and a fan-like blind embodiment 13 attached to the rear top surface of the frame 11 via double-sided adhesive tape or fastening agent in abutment against the transparent glass 12 thereof.

There are some drawbacks to such conventional locating device of a fan-like blind embodiment. Most of all, the fan-like blind embodiment 13 is simply fastened on top of the frame 11 in abutment against the transparent glass 12 thereof with a room A exposed under the base of the blind embodiment 13 thereof as shown in FIG. 1. In case the door/window is closed by great force, the blind embodiment 13 thereof can easily tilt back or fall down from the frame 11 thereof.

Please refer to FIG. 2. A second conventional locating device of a fan-like blind embodiment includes a pattern frame 12' fixed on top of the frame 11 of the door/window 10 thereof. A shallow groove 121' is disposed at the inner side of the pattern frame 12'. The fan-like blind embodiment 13 attached to the top of the frame 11 via double-sided adhesive tape or fastening agent is adapted to the shallow groove 121' of the pattern frame 12' at the top edge thereof.

The second conventional locating device of a fan-like blind embodiment shows some disadvantages. Most of all, the fan-like blind embodiment 13 is simply fastened on top of the frame 11 thereof with a room A exposed at the base without any support from under the base or from both sides thereof as shown in FIG. 2. Although adapted at the shallow groove 121' of the pattern frame 12', the top edge of the blind embodiment 13 can easily detach and fall from the shallow groove 121' thereof in case of great force applied onto the door/window 10 in closing/opening. Thus, the fan-like blind embodiment 13 must be repeated pushed back into the shallow groove 121' therein, which is quite inconvenient in use.

SUMMARY OF THE PRESENT INVENTION

It is, therefore, the primary purpose of the present invention to provide a locating device of a fan-like blind embodiment wherein, via a locating device made up of a retaining mount and a pair of support boards, a fan-like patterned blind embodiment is securely sustained at the base by an arc top surface of the retaining mount thereof and limited by the support boards at both front and rear sides thereof so that, in the repeated closing/opening of a door/window, the patterned blind embodiment can be stably located at a frame of the door/window thereon without tilting or falling there-from, effecting the best using condition thereof.

DETAILED DESCRIPTION OF THE PREFERRED EMBODIMENTS

Figure 2:
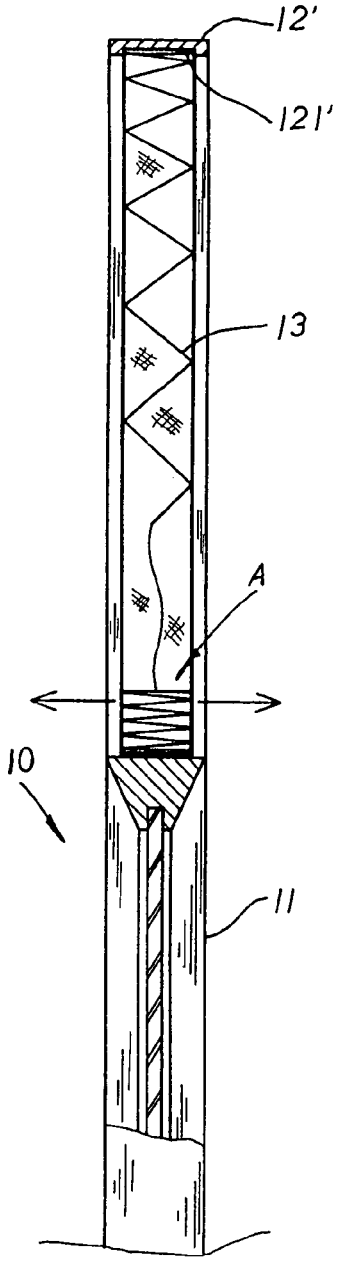
FIG. 2 PRIOR ART
FIG. 2 is a cross sectional view of another conventional fan-like blind embodiment in assembly.
Figure 1:
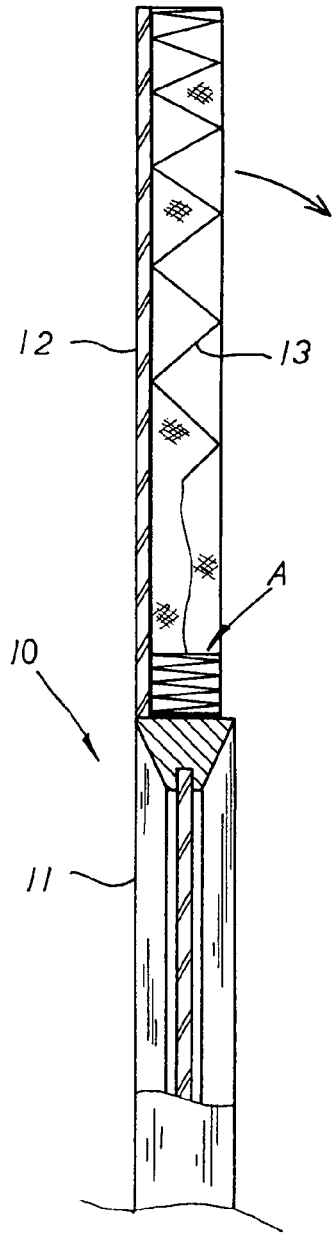
FIG. 1 PRIOR ART
FIG. 1 is a cross sectional view of a conventional fan-like blind embodiment in assembly.
Figure 3:
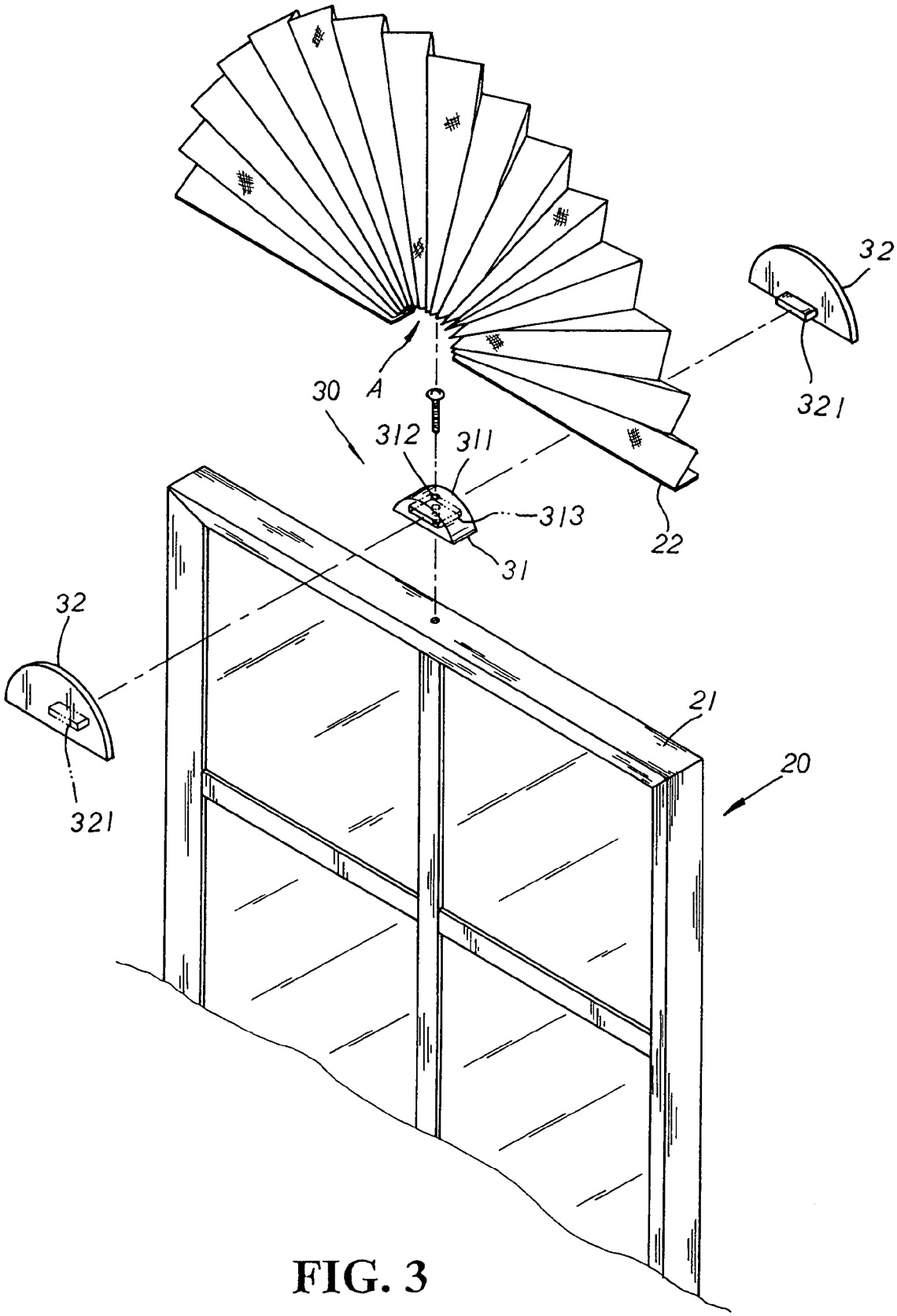
FIG. 3 is a perspective exploded view of the present invention.
Figure 4:
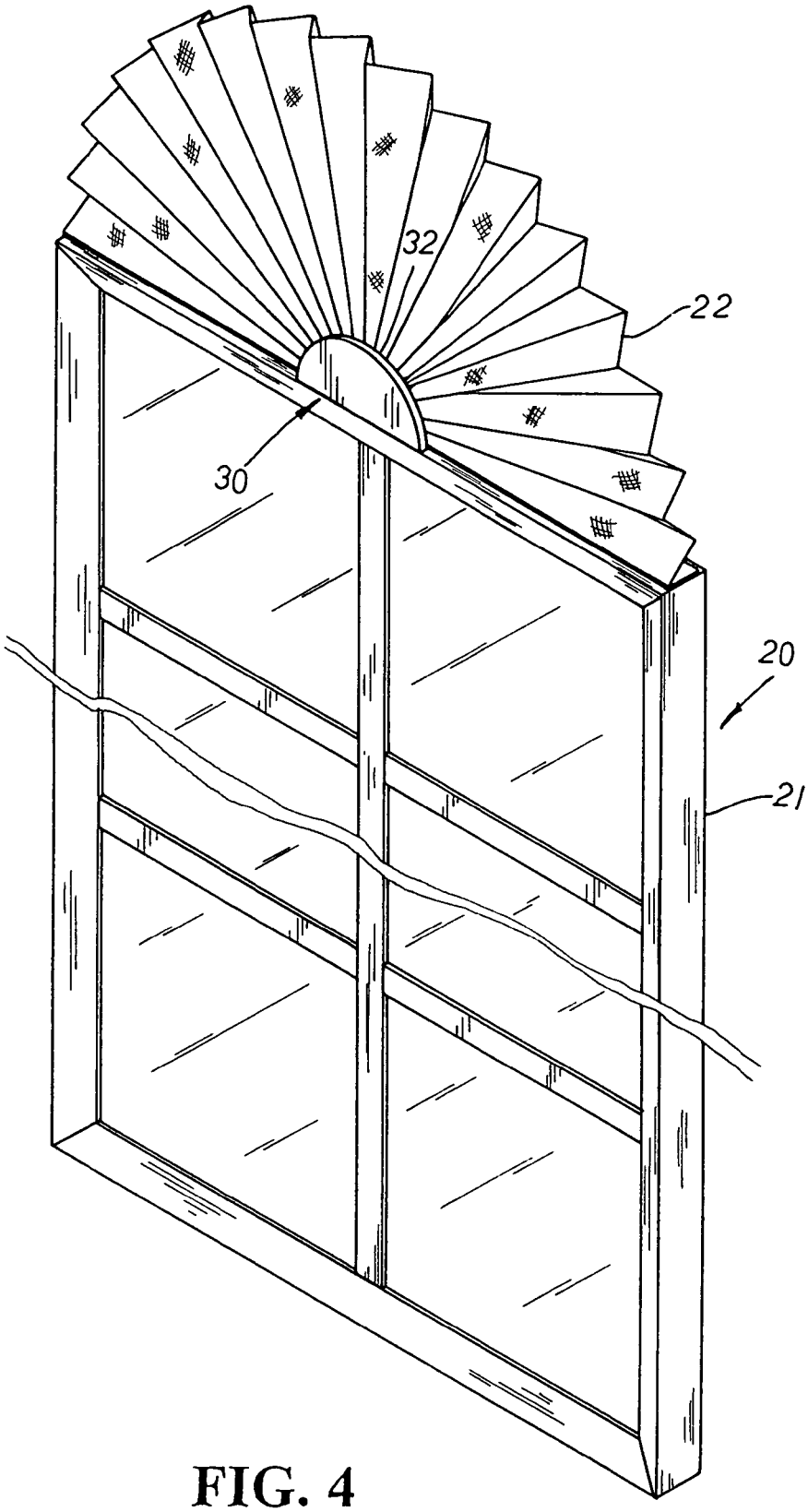
FIG. 4 is a perspective view of the present invention in assembly.
Figure 5:
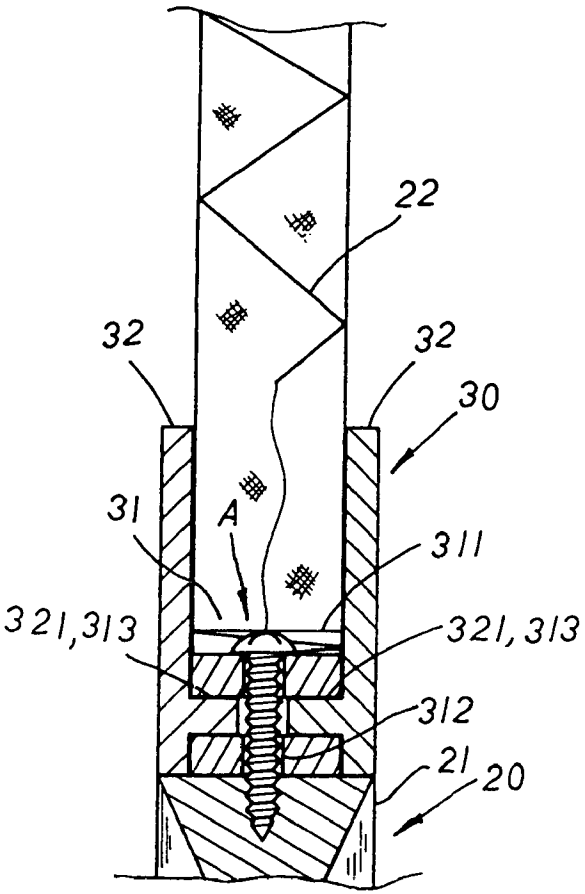
FIG. 5 is a cross sectional view of the present invention in assembly.

Please refer to FIGS. 3 to 5 inclusive. The present invention is related to a locating device of a fan-like blind embodiment, comprising a door/window 20 with a frame 21, a fan-like patterned blind embodiment 22 attached at the top of the frame thereon, and a locating device 30 adapted into a room A exposed under the base of the patterned blind embodiment 22 thereof. The locating device 30 is made up of a retaining mount 31 and a pair of supporting boards 32. The retaining mount 31 has an arc top surface 311 defining the top side thereon correspondingly matched to the base of the patterned blind embodiment 22, a through hole vertically disposed at the center there-through to fix the retaining mount 31 thereof onto the top surface of the frame 21 thereby, and a coupling groove 313 transversely defining the middle section thereon for a protruded part 321 of each support board 32 to be inserted thereto respectively to locate the support boards 32 at both lateral sides of the retaining mount 31 thereon. The design of the support boards 32 thereof can be properly matched to pattern of the blind embodiment 22 thereof for variety. Via the locating device 39 thereof, the patterned blind embodiment 22 is securely sustained at the base by the arc top surface 311 of the retaining mount 31 adapted at the room A therein, and limited by the support boards 32 at both front and rear sides thereof as shown in FIG. 5. Thus, in the repeated closing/opening of the door/window 20, the patterned blind embodiment 22 can be stably located at the frame 21 thereon without tilting or falling there-from, effecting the best using condition thereof.

Figure 6:
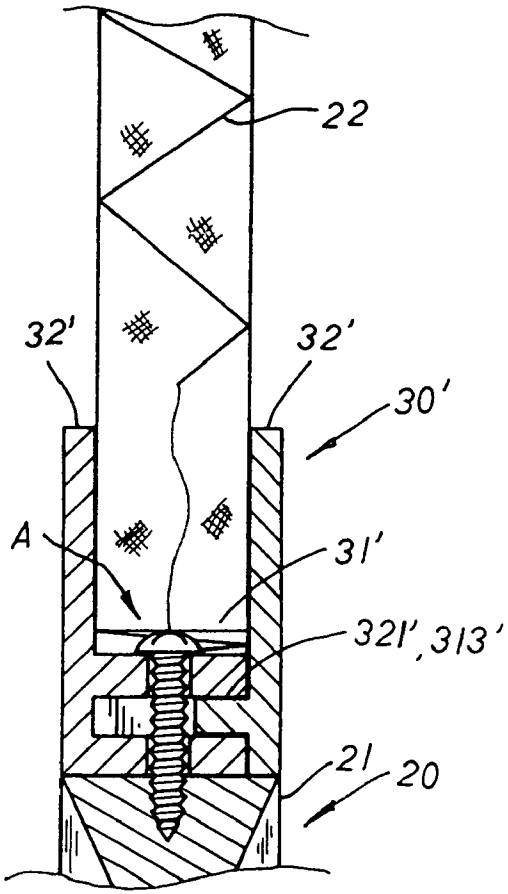
FIG. 6 is a cross sectional view of another embodiment of the present invention.

Please refer to FIG. 6. The fan-like patterned blind embodiment 22 can also be mounted onto the frame 20 thereof via a locating device 31' having a retaining mount 31' integrally molded with a support board 32' at one side thereof. The retaining mount 31' also has a coupling groove 313' correspondingly matched to a protruded part 321' of another support board 32' to engage the second support board 32' thereof with the retaining mount 31 thereby.

What is claimed is:

1. A locating device supporting a fan shaped blind connected to a top of a frame comprising:

a) a retaining mount inserted into an arched room located in a center of a bottom of the fan shaped blind and connected to the frame;

b) a first supporting board removably connected to the retaining mount and located on a first side of the fan shaped blind; and c) a second supporting board removably connected to the retaining mount and located on a second side of the fan shaped blind, wherein the retaining mount having a coupling groove, the first supporting board having a first protruded part, the second supporting board having a second protruded part, the first protruded part and the second protruded part are inserted in the coupling groove of the retaining mount locating the first supporting board and the second supporting board on lateral sides of the retaining mount.

2. A locating device for supporting a fan shaped blind connected to a top of a frame comprising:

a) a retaining mount inserted into an arched room located in a center of a bottom of the fan shaped blind and connected to the frame;

b) a first supporting board connected to the retaining mount and located on a first side of the fan shaped blind; and c) a second supporting board removably connected to the retaining mount and located on a second side of the fan shaped blind, wherein the retaining mount having a coupling groove, the retaining mount is formed of one piece with the first supporting board, the second supporting board having a protruded part, the protruded part is inserted in the coupling groove of the retaining mount, the first supporting board and the second supporting board are located on opposing sides of the retaining mount.

* * * * *